US005215048A

United States Patent [19]

Kaiser et al.

[11] Patent Number: 5,215,048

[45] Date of Patent: Jun. 1, 1993

[54] CAMSHAFT FOR MULTI-VALVE INTERNAL COMBUSTION ENGINE

[75] Inventors: Hans-Juergen Kaiser, Dueren, Fed. Rep. of Germany; Patrick Philips, Birmingham, Mich.; Bernhard Rosemann, Simmerath, Fed. Rep. of Germany; Andreas Schamel, Bonn, Fed. Rep. of Germany; Rainer Steinberg, Leverkusen-Opladen, Fed. Rep. of Germany

[73] Assignee: Ford Motor Company, Dearborn, Mich.

[21] Appl. No.: 852,155

[22] PCT Filed: Oct. 4, 1990

[86] PCT No.: PCT/GB90/01513

§ 371 Date: Mar. 30, 1992

§ 102(e) Date: Mar. 30, 1992

[87] PCT Pub. No.: WO91/05147

PCT Pub. Date: Apr. 18, 1991

[30] Foreign Application Priority Data

Oct. 4, 1989 [DE] Fed. Rep. of Germany ..... 3933021

[51] Int. Cl.[5] ..... F01L 1/04; F01L 1/26

[52] U.S. Cl. ..... 123/90.6; 123/90.22; 74/567

[58] Field of Search ..... 123/90.15, 90.17, 90.22, 123/90.23, 90.27, 90.6, 308, 315, 432; 74/567

[56] References Cited

U.S. PATENT DOCUMENTS 4,852,527 8/1989 Beardmore et al. ..... 123/90.6

4,878,462 11/1989 Kurisu et al. ..... 123/90.6

*Primary Examiner*—E. Rollins Cross

*Assistant Examiner*—Weilun Lo

*Attorney, Agent, or Firm*—J. R. Drouillard; R. L. May

[57] ABSTRACT

A camshaft (16) is described for operating the primary and secondary inlet or exhaust valves (12) of an internal combustion engine having multiple valves in each cylinder, the camshaft having cams (18*a*, 18*b*) of substantially the same cam profile and phase for operating the primary and secondary valves of each cylinder. In accordance with the invention, in order to reduce valve train noise at least the trailing ramps of the cams (18*a*, 18*b*) are offset by between 1° and 3° relative to one another.

3 Claims, 4 Drawing Sheets

CAMSHAFT FOR MULTI-VALVE INTERNAL COMBUSTION ENGINE

FIELD OF THE INVENTION

The invention relates to a camshaft for a multi-valve internal combustion engine of the type having at least two adjacent inlet and/or two exhaust valves per cylinder.

BACKGROUND OF THE INVENTION

It is has already been proposed to design the valve drive train in an internal combustion having multiple valves to allow the primary and secondary valves to have different events. An example of a camshaft which allows two inlet valves to have different events is shown EP-A-0 319 956. It has furthermore been suggested to vary the phase of the secondary valve in relation to the primary valve in dependence upon engine operating conditions.

In the prior art, the event timing of each valve has been selected or controlled with a view to determining the charging of the engine, the aim often being to improve the volumetric efficiency by maximising the mass of the intake charge. As a result, in the prior art, where a primary valve and a secondary valve have different events, the difference has been a major one affecting either the durations or the relative phasing of the events.

The present invention is not, by contrast, concerned with controlling the charging of the engine cylinders and relates to engines in which the primary and secondary valves have substantially the same event timing and duration, the purpose of providing two valves being only to increase the combined valve skirt area and the through flow cross section of the valves when they are open.

The invention is instead concerned with the noise emitted from an engine. In any engine, the valve mechanism is a source of noise and this problem is accentuated in a multi-valve engine since there are more valves to operate.

OBJECT OF THE INVENTION

The invention seeks to reduce valve train noise in an engine having multiple inlet and/or exhaust valves in which the secondary valves and primary valves are operated with substantially the same event phase and duration

SUMMARY OF THE INVENTION

In accordance with the present invention there is provided a camshaft for operating the primary and secondary inlet or exhaust valves of an internal combustion engine having multiple valves in each cylinder, the camshaft having cams of substantially the same cam profile and phase for operating the primary and secondary valves of each cylinder, characterised in that at least the trailing ramps of the cams are offset by between 1° and 3° relative to one another.

In one embodiment of the invention, both the leading and the trailing ramps are offset in the same direction so that the cams are identical in profile but phase shifted relative to one another by between 1° and 3°.

In an alternative embodiment of the invention, the leading ramps may be in phase with one another and only the trailing ramps offset, so that one cam has an event duration slightly longer than the other.

It will be noticed that the offset of 1° to 3° is too small to have any serious effect on the charging of the cylinder but, as will be explained below, it results in a marked reduction in the noise emitted by the valve train.

It should be pointed out briefly that valve train noise has several causes. In particular, one may distinguish between two excitations mechanisms, which are herein termed impulse excitation and force excitation. Impulse excitation consists of impulses which occur on valve opening, valve closing and following loss of contact between valve train components. Force excitation is caused by varying inertial forces, valve train oscillations, or the jerk occurring on a transition between hydrodynamic lubrication and metallic contact.

Generally, impulse excitation is the predominant source of noise at low and medium engine speeds and force excitation is predominant at high speed. If valve bounce occurs, impulse excitation can again in some cases again become predominant at very high engine speeds.

In the present invention, impulse excitation during valve closing is reduced by the staggering the impulses from the two valves. In practice, this step has been found to result in a significant reduction in valve train noise, ranging from 2 to 2.5 dB(A) at low load and part load, reducing to 1 dB(A) at full load. This noise reduction occurs in the range of between 600 and 6000 Hertz, to which the human ear is particularly sensitive.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1B:
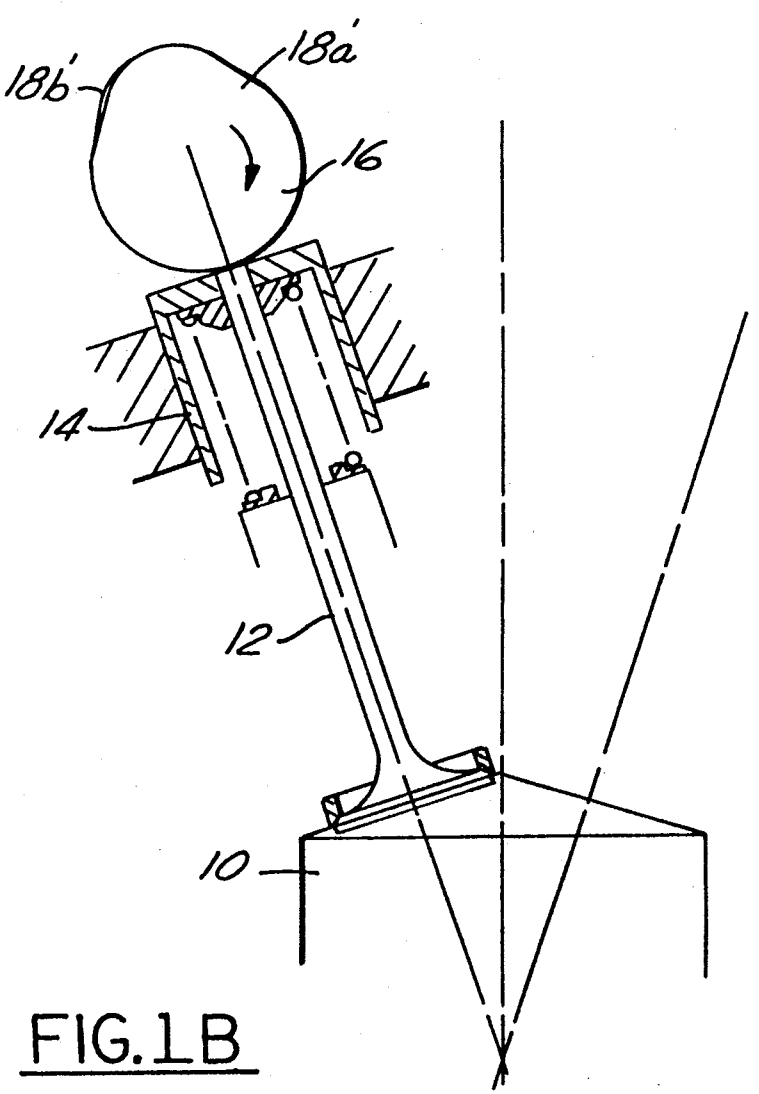
FIGS. 1*a* and 1*b* are schematic representations of valve trains constructed in accordance with two different embodiments of the invention.
Figure 1A:
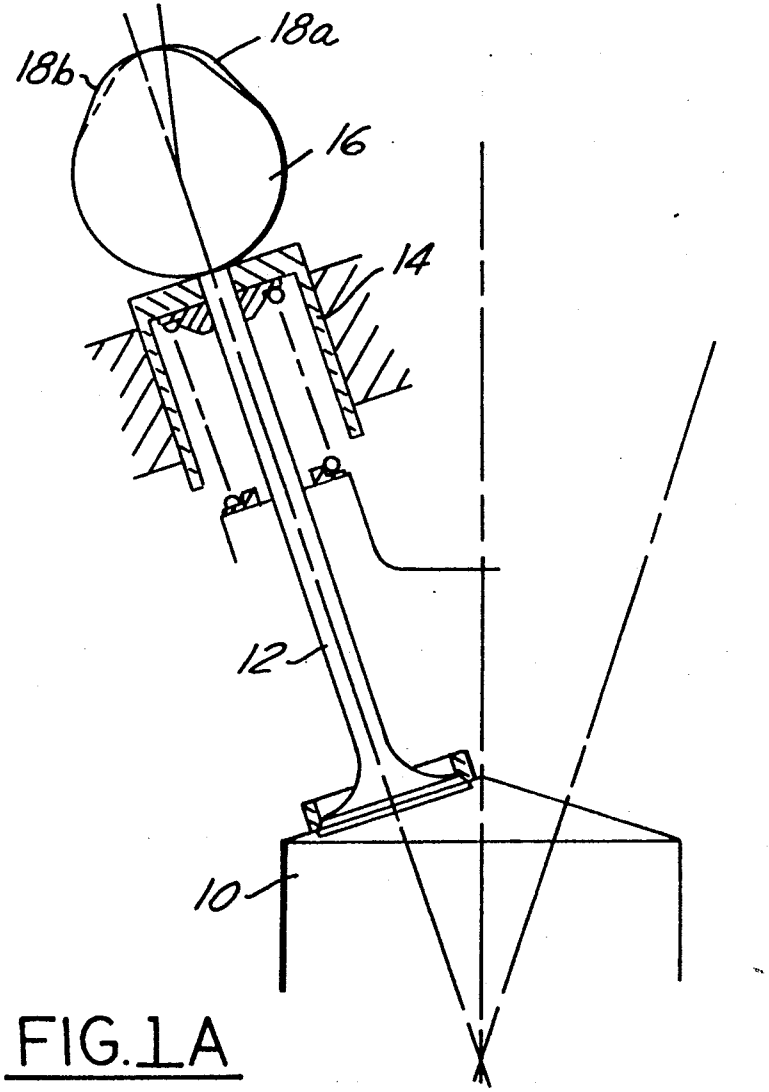

FIG. 1*a* shows a cylinder 10 with two inlet valves 12 lying one behind the other as viewed so that only one can be seen in the drawing. The inlet valves 12 are operated through respective bucket followers 14 by a camshaft 16 which has two cams 18*a* and 18*b*. The cams in this embodiment of the invention have the same profile but they are offset from one another by an angle of between 1° and 3° as illustrated. FIG. 1*b* is essentially the same except that the cams 18*a'* and 18*b'* differ slightly in shape so that they open their valves at the same time but one closes its valve between 1° and 3° before the other.

Figure 2A:
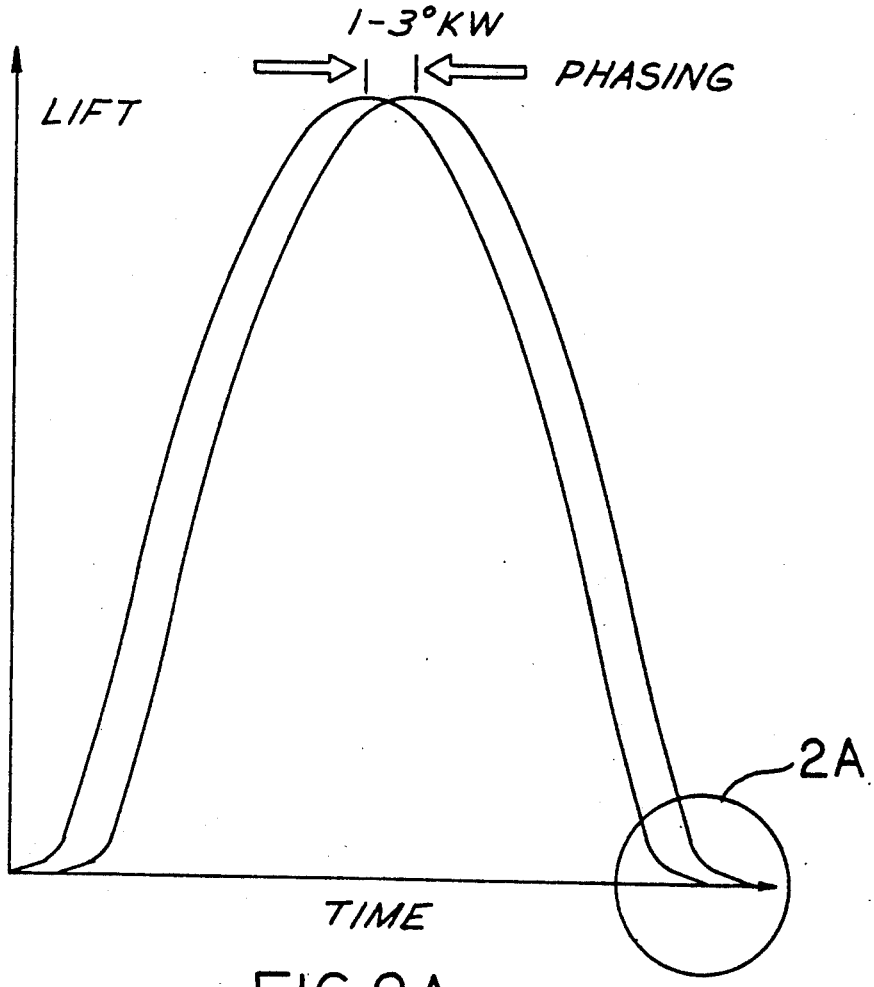
FIG. 2*a* is a graph of position plotted against time of the primary and secondary valves when operated by the camshaft shown in FIG. 1*a*.
Figure 2B:
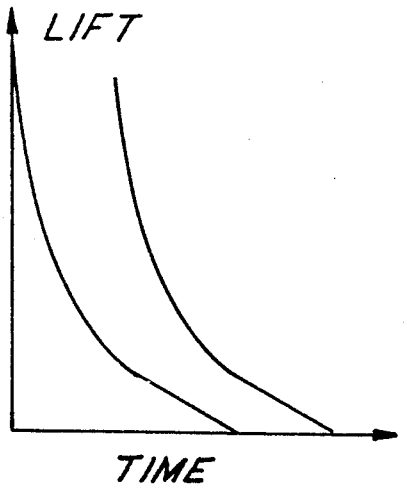
FIG. 2*b* is a detail of FIG. 2*a* drawn to an enlarge scale.
Figure 2C:
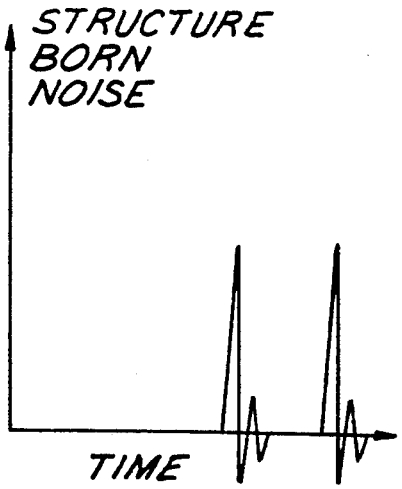
FIG. 2*c* is a graph of noise versus time drawn to the same time scale as FIG. 2*b*.

The valve displacements versus time for the primary and secondary valves of each valve pair for the embodiment of FIG. 1*a* is shown in FIG. 2*a*. It can be seen clearly from this drawing that the cams 18*a* and 18*b* have identical profiles which have been phase shifted by 1° to 3°. The effect of this phase shift on the closing of the valves is shown to a larger scale in FIG. 2*b* and FIG. 2*c* shows that the impulses excitations are similarly phase displaced.

Figure 3A:
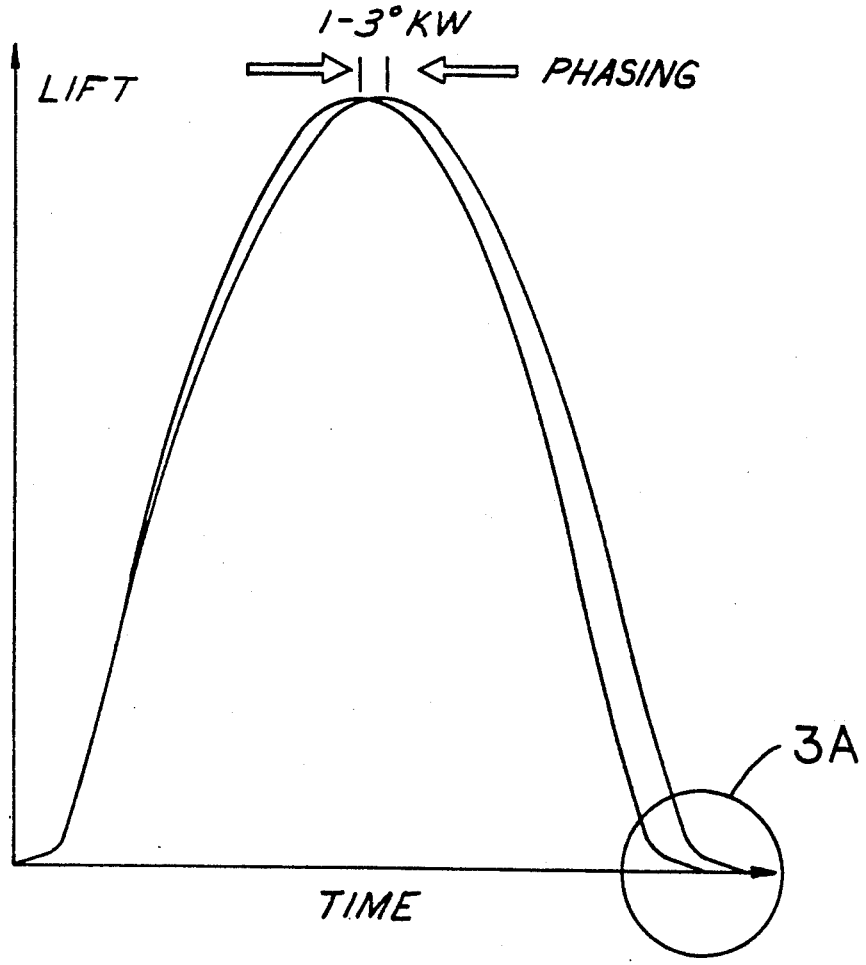
FIG. 3*a* is a graph of position plotted against time of the primary and secondary valves when operated by the camshaft shown in FIG. 1*a*.
Figure 3B:
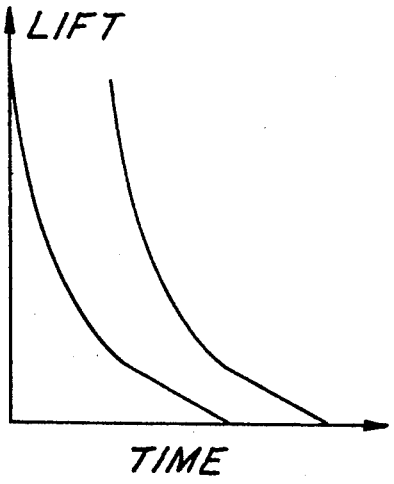
FIG. 3*b* is a detail of FIG. 3*a* drawn to an enlarge scale.
Figure 3C:
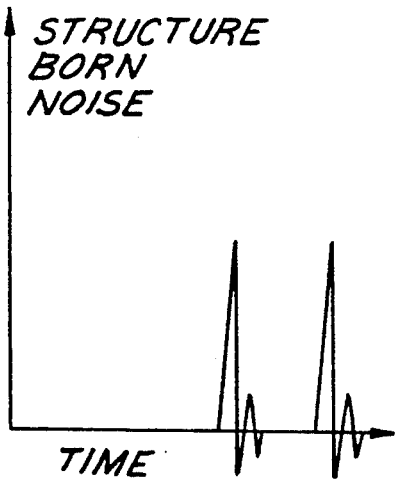
FIG. 3*c* is a graph of noise versus time drawn to the same time scale as FIG. 3*b*.

FIGS. 3*a* to 3*c* show that essentially the same results are achieved by the embodiment of FIG. 1*b*, in which the cam profile is slightly modified. In FIG. 3*a*, the leading ramps of the cams start at the same point in time and it is only the trailing ramps that are phase shifted. As a further alternative, one cam can lead during the opening by 1° to 3° and trail by this amount during valve closing, the essential feature being that at least the impulse excitations from the two valves while closing are phase shifted from one another.

In a conventional engine, the simultaneous closing of the two valves produces noises at the same instant which reinforce one another. The increase impulse excitation also initiates oscillations in the camshaft and other components of the valve train at harmonics of their natural or resonant frequency to increase the volume of the noise resulting from force excitation.

In the invention, the staggering of the two impulse excitations which occur during valve closing prevents them from reinforcing one another. Furthermore, the force excitation will be reduced because of the phase difference between the noise pulses.

Figure 4:
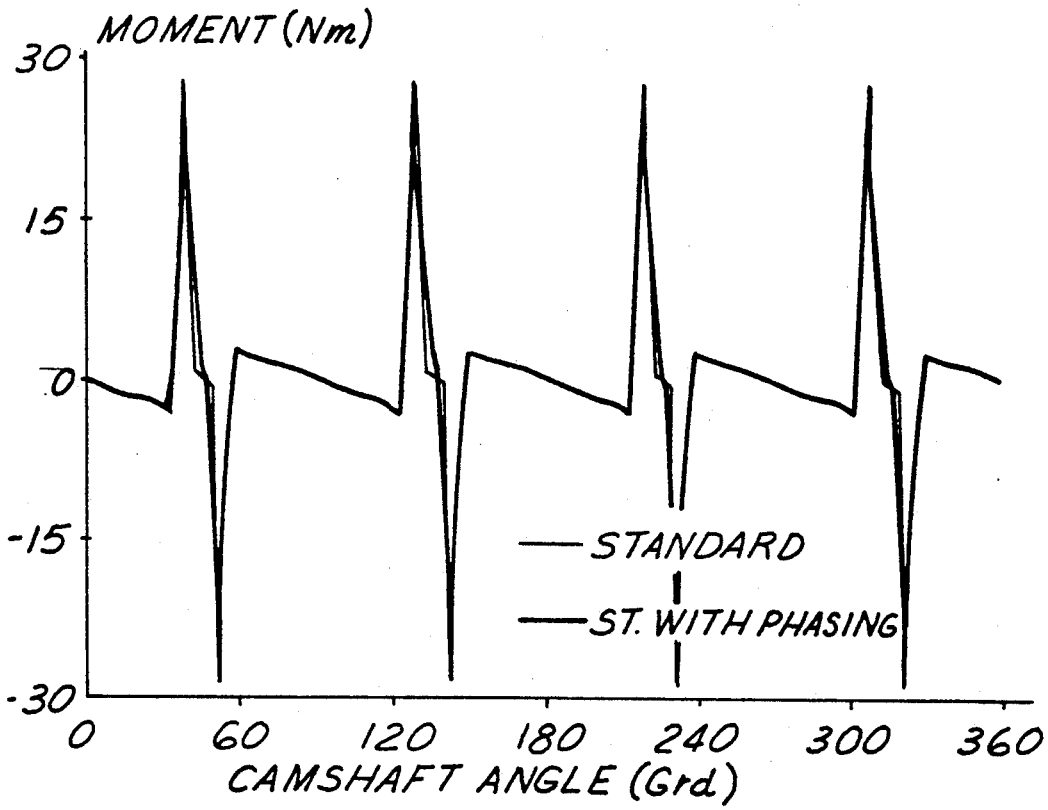
FIG. 4 is a graph comparing the variations of moments on the camshaft with camshaft angle, for a conventional camshaft and a camshaft in accordance with the invention.

FIG. 4, which shows the variation of the moment of forces acting on the camshaft with time, illustrates that the reduction of the impact excitation not only reduces noise but also reduces the amplitude of the moments acting on the camshaft, thereby reducing the stresses thereon.

At each engine speed, the camshaft is subjected to torque fluctuations which have a speed related frequency. When these beat with the natural frequencies and harmonics of the camshaft, then resonance occurs which is a further source of noise.

Figure 5:
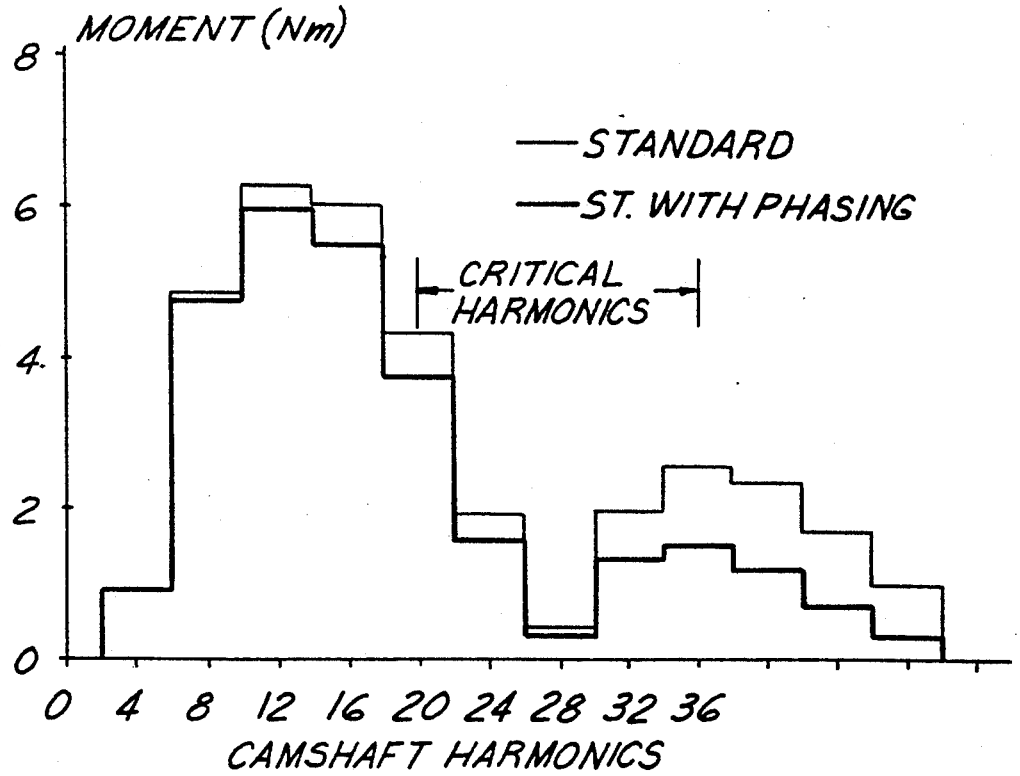
FIG. 5 is a graph of the amplitude of the moments acting on the camshaft at different harmonics of the natural frequency of the camshaft for a conventional camshaft and a camshaft in accordance with the invention.

From FIG. 5, which is a Fourier analysis of the moments shown in FIG. 4, it can be seen that the amplitude of the torque fluctuations at all frequencies is lower in the case of a camshaft of the invention than with a conventional camshaft and that a significant reduction occurs in the critical range of harmonics marked in the drawing.

Because of the reduced impulse and force excitations, it has been found that a camshaft of the invention can achieve a noise reduction of between 2 and 2.5 dB(A) at low and medium engine load. At high load, a reduction of 1 dB(A) can be achieved by staggering the closing times of the primary and secondary valves.

It should be mentioned that since the invention is not concerned with better breathing, it is equally applicable to inlet and exhaust valves.

We claim:

1. A camshaft for operating a primary and a secondary inlet or exhaust valves (12) of an internal combustion engine having multiple valves in each cylinder, the camshaft (16) having cams (18*a*, 18*b*; 18*a'*, 18*b'*) of substantially the same cam profile and phase for operating the primary and the secondary valves (12) of each cylinder, characterised in that at least trailing ramps of the cams (18*a*, 18*b*; 18*a'*, 18*b'*) are offset by between 1° and 3° relative to one another.

2. A camshaft as claimed in claim 1, wherein both leading and the trailing ramps are offset in the same direction so that the cams (18*a*, 18*b*) are identical in profile but phase shifted relative to one another by between 1° and 3°.

3. A camshaft as claimed in claim 1, wherein leading ramps of the cams are in phase with one another and only the trailing ramps offset, so that one cam (18*b'*) has an event duration slightly longer than the other (18*a'*).

* * * * *